US010750878B2

(12) United States Patent
Sozzo

(10) Patent No.: US 10,750,878 B2
(45) Date of Patent: Aug. 25, 2020

(54) BOOSTER SEATS FOR CHILDREN

(71) Applicant: Artsana S.p.A., Grandate (CO) (IT)

(72) Inventor: David Sozzo, Milan (IT)

(73) Assignee: ARTSANA S.P.A., Grandate (CO) (IT)

( * ) Notice: Subject to any disclaimer, the term of this patent is extended or adjusted under 35 U.S.C. 154(b) by 0 days.

(21) Appl. No.: 16/062,643

(22) PCT Filed: Dec. 21, 2016

(86) PCT No.: PCT/IB2016/057881
§ 371 (c)(1),
(2) Date: Jun. 15, 2018

(87) PCT Pub. No.: WO2017/109723
PCT Pub. Date: Jun. 29, 2017

(65) Prior Publication Data

US 2018/0360229 A1 Dec. 20, 2018

(30) Foreign Application Priority Data

Dec. 21, 2015 (IT) ..... 102015000085798

(51) Int. Cl.
*A47D 1/10* (2006.01)
*B65H 75/44* (2006.01)
*B65H 75/48* (2006.01)

(52) U.S. Cl.
CPC ..... *A47D 1/103* (2013.01); *B65H 75/4431* (2013.01); *B65H 75/48* (2013.01)

(58) Field of Classification Search
None
See application file for complete search history.

(56) References Cited

U.S. PATENT DOCUMENTS 3,612,094 A * 10/1971 Hare ..... B65H 75/38 137/355.2
5,383,708 A 1/1995 Nagasaka et al.
6,526,918 B1 * 3/2003 Arnold ..... A01K 27/004 119/796
8,151,735 B1 * 4/2012 McCrocklin ..... A01K 27/003 119/796

(Continued)

OTHER PUBLICATIONS

International Search Report and Written Opinion dated Apr. 13, 2017, in PCT Application No. PCT/IB2016/057881, 10 pages.

*Primary Examiner* — David E Allred
(74) *Attorney, Agent, or Firm* — MH2 Technology Law Group LLP

(57) ABSTRACT

A booster seat includes: a seat having an inner cavity; at least one winding drum, in the cavity, configured to rotate in a first direction in which the belt is unwound from the at least one winding drum and in a second direction in which the belt is wound up on the at least one winding drum; first elastic members, configured to operate on the at least one winding drum to counteract rotation of the at least one winding drum in the first direction; and lock members, configured to operate on the at least one winding drum and/or the belt, and configured to switch between a retaining position, in which the lock members inhibit rotation of the at least one winding drum and/or movement of the belt, and a release position, in which the lock members permit rotation of the at least one winding drum and/or movement of the belt.

20 Claims, 3 Drawing Sheets

(56) References Cited

U.S. PATENT DOCUMENTS

| | | | | |
|---|---|---|---|---|
| 2011/0220036 | A1* | 9/2011 | Matthews | A01K 27/004 119/796 |
| 2013/0001992 | A1 | 1/2013 | Hartenstine et al. | |
| 2013/0127218 | A1 | 5/2013 | Carpenter et al. | |
| 2015/0075449 | A1* | 3/2015 | O'Brien | A01K 27/004 119/797 |
| 2016/0278345 | A1* | 9/2016 | Holmstrom | A01K 27/004 |

* cited by examiner

BOOSTER SEATS FOR CHILDREN

CROSS-REFERENCE TO RELATED APPLICATION(S)

This application is a national stage entry from International Application No. PCT/IB2016/057881, filed on Dec. 21, 2016, in the Receiving Office ("RO/IB") of the International Bureau of the World Intellectual Property Organization ("WIPO"), and published as International Publication No. WO 2017/109723 A1 on Jun. 29, 2017; International Application No. PCT/IB2016/057881 claims priority from Italian Patent Application No. 102015000085798, filed on Dec. 21, 2015, in the Italian Patent and Trademark Office ("IPTO"), the entire contents of all of which are incorporated herein by reference.

The present invention relates to a booster seat for children.

Booster seats for children allow children to sit on normal chairs at a table, in case a child is too small to use a normal adult chair but has grown enough to find the high chair too narrow and uncomfortable, or when the use of the high chair is not practical (for example for size restrictions).

Prior art booster seats comprise a seating surface on which a child is seated and belts for firmly securing the seating surface to the normal chair.

At least two belts are usually provided, one for mechanically connecting the booster seat to the seat of the chair and the other for mechanically connecting the booster seat to the backrest of the chair.

The use of belts for connecting the booster seat to the chair is rather problematic in terms of convenience and safety.

Belts are prone to twisting and tangling when the booster seat is not in use, and require inconvenient preliminary operations each time the booster seat is used.

Furthermore, belts must be adapted to the particular chair upon which the booster seat is to be secured, and must be particularly lengthened or shortened to effectively encircle the backrest and/or the seat of the chair. For this purpose, belts are usually formed as a closed loop, whose length may be changed to fit the overall length of the belt. Also in this case, time-consuming and inconvenient preliminary steps may be required for belt length adaptation.

Also, it is not always possible and it is never easy to encircle the chair with the belts at the proper tension, and this will create potential danger conditions for the child that uses the booster seat.

The present invention has the object of obviating the drawbacks of the above-described booster seat.

Particularly, the present invention has the object of providing a booster seat for children that prevents belts from tangling when not in use.

A further object of the present invention is to provide a booster seat for children that can be easily and safely connected to a normal chair.

These and other objects, as better explained hereafter, are fulfilled by a booster seat for children as defined in the accompanying claim 1.

The invention will be now described in greater detail with reference to the annexed drawings, which show a preferred embodiment of the invention, given by way of illustration and without limitation, in which.

Figure 1:
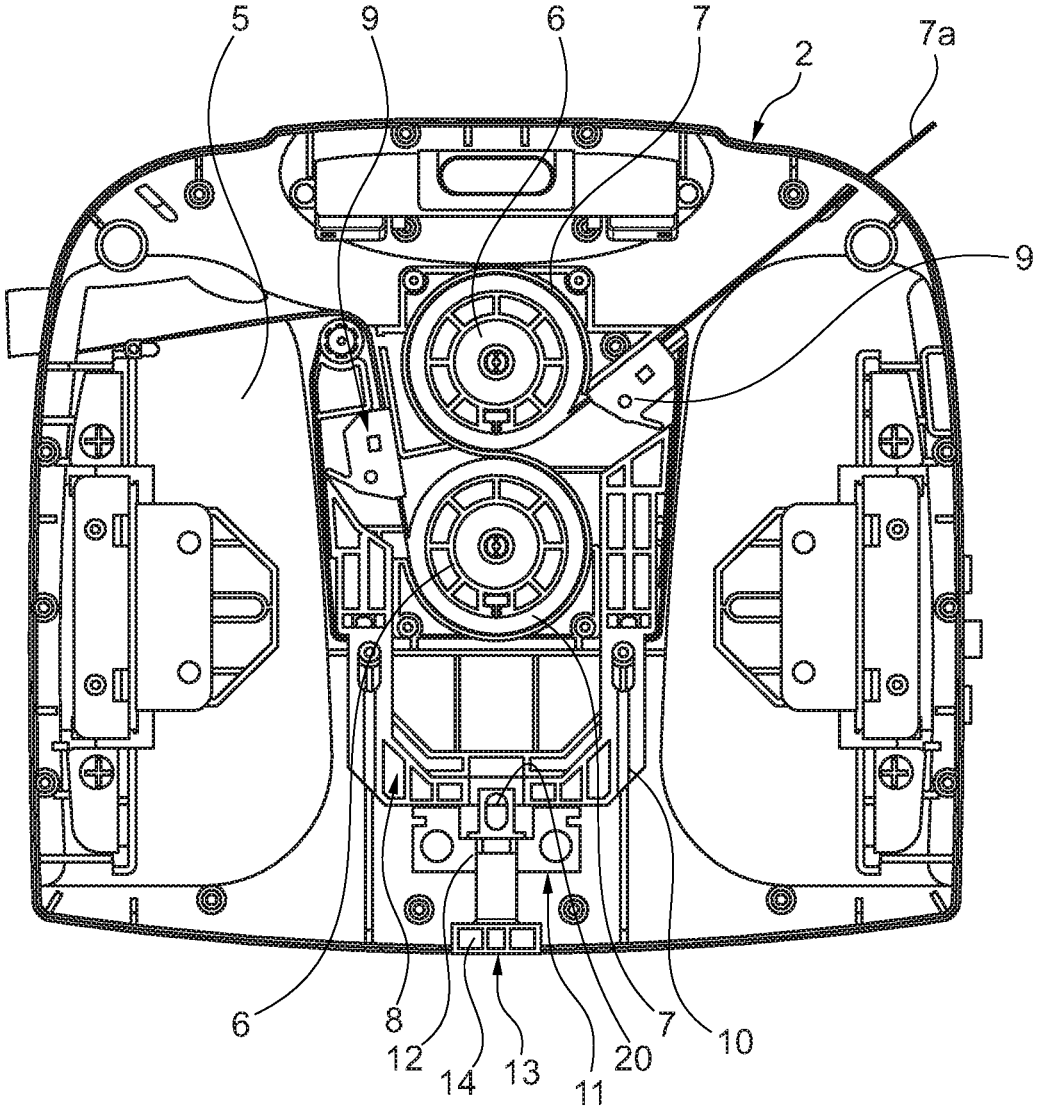
FIG. 1 shows a plan view of a booster seat for children of the present invention, with certain parts omitted to more clearly show other parts.

Referring to the aforementioned figures, a booster seat of the present invention has been generally designated by numeral 1.

The booster seat 1 comprises a seat 2 which is configured to accommodate a child. Preferably, the booster seat 1 also comprises a backrest 3 (as partially shown in FIG. 2) which may be movable or formed of one piece with the seat 2, and a pair of elbow rests 4.

The seat 2 has an inner cavity 5 defined between a top surface of the seat (upon which the child is seated) and a bottom surface, which is configured to contact the chair upon which the booster seat is accommodated. FIG. 1 shows the booster seat with the top surface omitted to clearly show the cavity 5 and its contents.

At least one winding drum 6 is located in the cavity 5, and a belt 7 is wound thereupon, with an end 7*a* that comes out of the cavity 5 through a slit. The end 7*a* of the belt that emerges from the cavity 5 preferably has a free end with an anchor member allowing it to be secured to a complementary anchor member joined to the booster seat, for the belt to form a closed loop. The end 7*a* of the belt 7 that emerges from the cavity 5 has the purpose of allowing a chair portion, i.e. a portion of the backrest or the seat of the chair, to be encircled to connect the booster seat to the chair. In the preferred embodiment of the invention, two winding drums 6 are provided, each having its respective belt 7, as shown in FIG. 1. The following description made in relation to one drum and one belt will also apply to the other drum and the other belt.

The drum 6 can rotate about a substantially vertical axis in first and second opposite directions. As used herein, the terms "vertical" and "horizontal" shall be intended in relation to the position of use of the booster seat. The belt 7 is wound around the drum 6 when the latter rotates in the second direction and is unwound from the drum when the latter rotates in the first direction.

First elastic members (not shown) act upon the drum 6 to counteract its rotation in the first direction, i.e. to prevent the belt from unwinding. More particularly, the first elastic members wind the belt 7 around the drum 6 when the belt is free to move. In the preferred embodiment of the invention, the first elastic members consist of a torsion spring which directly biases the drum 6.

The booster seat 1 also comprises lock members 8 operating on each drum 6 between a retaining position in which they inhibit rotation of the drum and/or movement of the belt, and a release position in which they permit rotation of the drum and/or movement of the belt. Preferably the lock members 8 operate on the belt 7 and comprise a slider 9 which is configured to move between the retaining position, in which the slider 9 mechanically interferes with the belt 7 to inhibit movement thereof, and the release position, in which the slider is moved apart and does not interfere with the belt 7. As shown in FIG. 1, each slider 9 is preferably hinged about a vertical axis to be able to rotate between the retaining position and the release position. Second elastic members 9*a* operate on the slider 9 to counteract the movement thereof from the release retaining position to the retaining release position. Such second elastic members 9*a* (see FIG. 2) consist, for instance, of a torsion spring that acts upon the hinge axis of the slider 9. The second elastic members 9*a* retain the slider in the position in which the latter retains the belt 7, by pushing the slider 9 against the belt 7 to prevent movement thereof.

The movement of the sliders 9 against the bias of the second elastic members 9*a* is obtained by a carriage 10, which is also part of the lock members 8.

The booster seat 1 further comprises first actuator members 11 operating on the lock members 8 to switch them to the release position. The first actuator members 11 comprise a user-operable pushbutton 12. According to one embodiment, the pushbutton 12 is placed on the bottom surface of the seat 2. Here, it shall be noted that the first actuator members 11 cannot be actuated when a child is on the booster seat, as the bottom surface of the seat 2, and hence the pushbutton 12, faces the chair with which the booster seat is coupled and cannot be accessed by the user. This will prevent the lock members from being inadvertently switched to the release position.

The booster seat further comprises second actuator members 13, operable on said first actuator members 11 and/or on the lock members 8 to switch the latter to the retaining position. In the preferred embodiment of the invention, the second actuator members 13 directly operate on the lock members 8, and particularly on the carriage 10. The second actuator members 13 comprise a pushbutton 14 that projects out of a front surface of the seat and is configured to be actuated by a user. Thus, the second actuator members 13 can be operated even when the booster seat is in its operating configuration and is accommodating a child.

It will be clear from the above that the first 11 and second 13 actuator members both directly operate on the lock members 8 and particularly on the carriage 10, to cause the belts 7 to be unwound or locked. For this purpose, the carriage 10 is configured to be translated along a direction perpendicular to the axis of rotation of the drums 6. The carriage 10 constantly contacts the sliders 9 and overcomes the elastic force of the second elastic members 9*a* when it is moved by the first actuator members 11 to move the sliders 9 away from the belts 7 and allow them to move.

Figure 2:
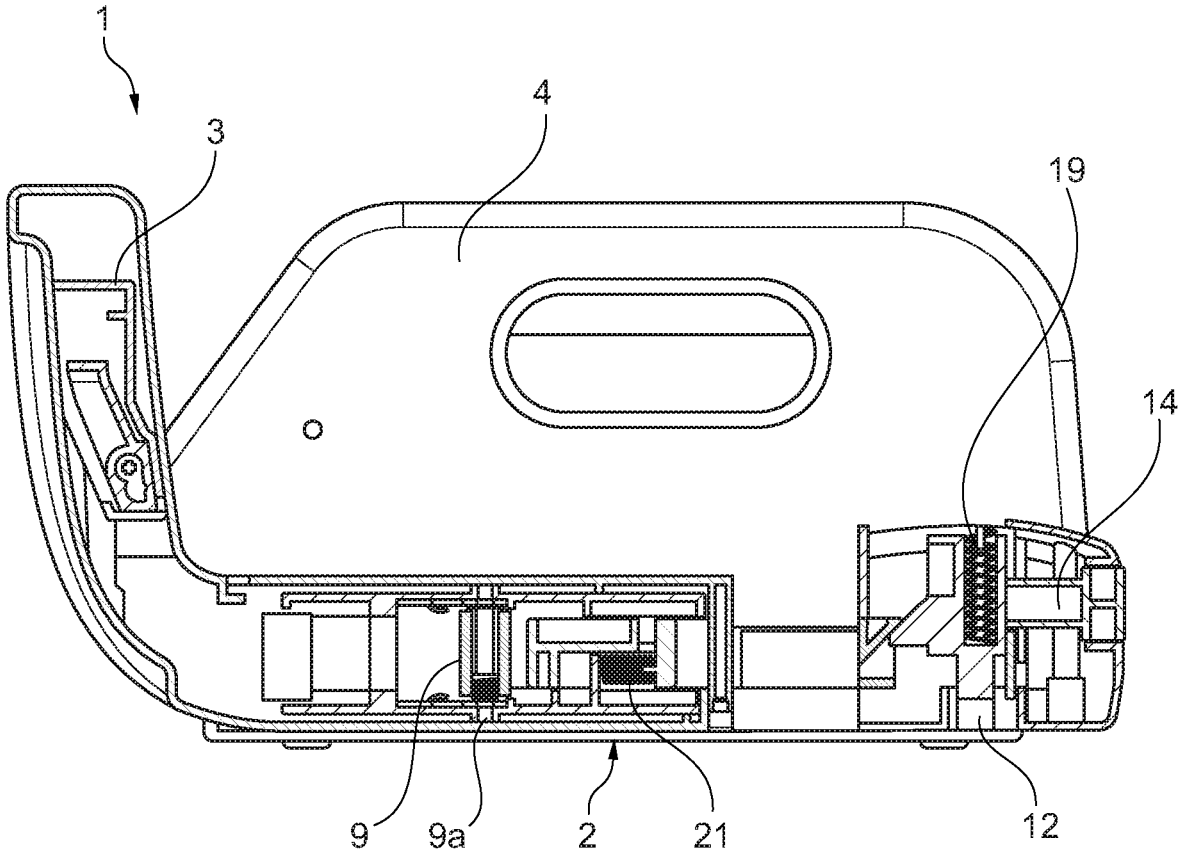
FIG. 2 shows a lateral view of the booster seat for children of FIG. 1, with certain parts omitted to more clearly show other parts.
Figure 3:
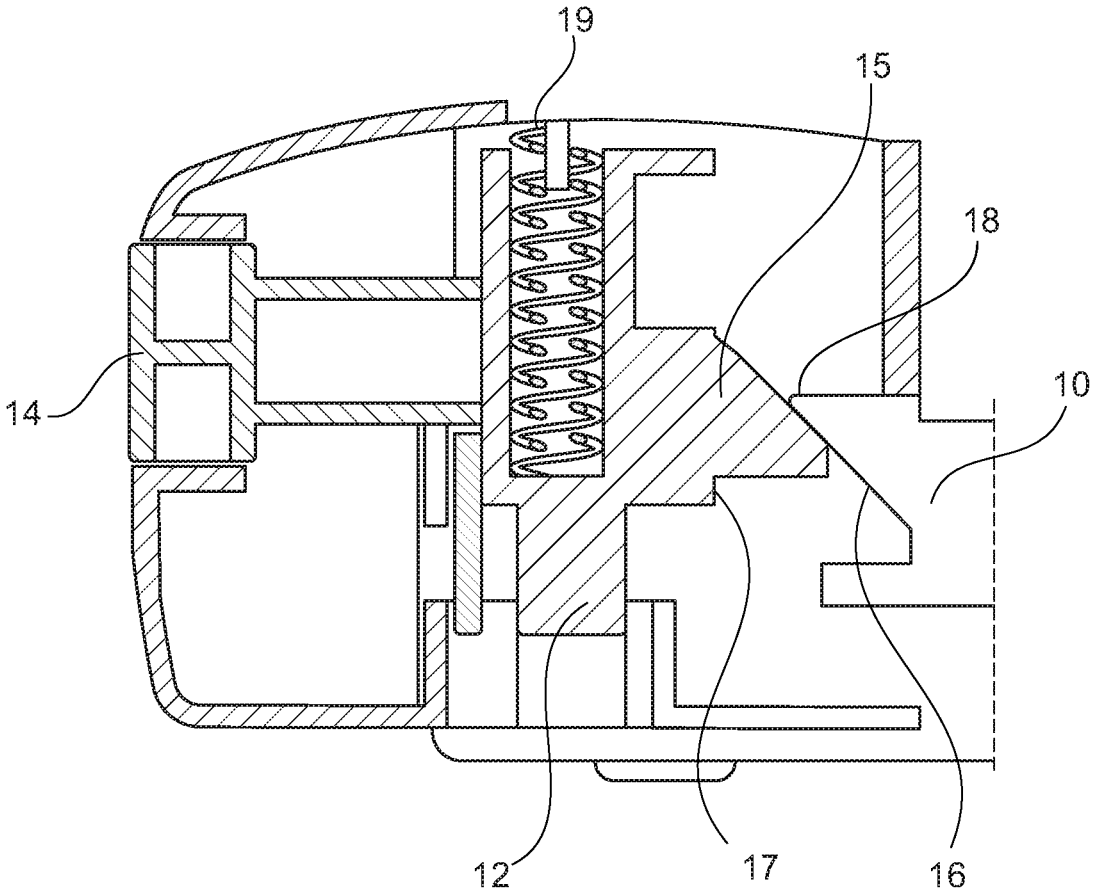
FIG. 3 is an enlarged view of certain details of the booster seat for children of FIG. 2.

In the preferred embodiment of the invention, the first actuator members 11 are configured to be stably switched to a stable unlocked position, in which the lock members 8 are in the release position, and to an inactive position, in which they do not interact with the lock members 8 (see FIG. 2). When the first actuator members 11 are in the stable unlocked position, they push the carriage 10 (as mentioned above) against the sliders 9 and cause them to rotate against the second elastic members 9*a* thereby releasing the sliding movement of the belts 7. In order to ensure the stability of this position of the first actuator members 11, such that they will constantly bias the carriage 10, the first actuator members 11 comprise a wedge-shaped portion 15. The carriage 10 has a wedge-shaped portion 16 substantially mating the shape of the wedge-shaped portion 15 of the first actuator members 11. The translation of the latter occurs in a vertical direction, i.e. perpendicular to the sliding direction of the carriage 10. Therefore, as the pushbutton 12 of the first actuator members 11 is actuated, a force with a horizontal component is transmitted to the carriage 10 and translates it (such force being transmitted by the wedge-shaped portion 15 of the first actuator members 11 to the wedge-shaped portion 16 of the carriage 10). The first actuator members 11 also have a shoulder 17 in the wedge-shaped portion 15 (see FIG. 3) which engages the edge of the carriage 10 having the wedge-shaped portion 16. Particularly, this shoulder 17 engages a cantilever member 18 carried by the wedge-shaped portion 16 of the carriage 10 and abuts it thereby preventing any translation of the pushbutton 12 (see FIG. 3).

By this arrangement, the first actuator members 11 will be in the stable unlocked position. In this position, the first actuator members 11, and preferably the pushbutton 12, act against third elastic members 19. The latter will tend to move the first actuator members 11 back to the inactive position.

The second actuator members 13 are configured to move between an active position and an inactive position. In the active position, the second actuator members 13 break the stability of the stable unlocked position of the first actuator members 11, thereby allowing the third elastic members 19 to switch the first actuator members 11 to the inactive position. When the second actuator members 13 are in the active position, the slider 9 is switched to the retaining position (thereby locking the belts 7 in position). Preferably, the second actuator members 13 comprise a pushing element 20 (as shown in FIG. 1) actuated by the pushbutton 14. The pushing element 20 acts upon the carriage 10 and translates it further beyond the position it had reached under the action of the first actuator members 11. This will cause the shoulder 17 to lose contact with the cantilever member 18 and will allow the pushbutton 12 to be translated under the action of the third elastic members 19. The translation of the pushbutton 12 under the action of the third elastic members 19 will switch the first actuator members 11 to the inactive position.

The return action of fourth elastic members 21, preferably combined with the action of the second elastic members 9*a* counteracts the action of the pushing element 20 and translates the carriage 10 to the position in which the slider 9 comes to mechanical interference with the belt 7 to prevent movement thereof.

The invention claimed is:

1. A booster seat for children, comprising:

a seat having an inner cavity;

at least one winding drum, for a belt to be wound up thereon, the belt having one end that comes out of the cavity, the winding drum being placed in the cavity and being able to rotate in one direction in which the belt is unwound from the drum and in a second direction in which the belt is wound up on the drum;

first elastic members, operating on the drum to counteract rotation of the drum in the first direction;

lock members, operating on the at least one drum and/or the belt, and configured to be switched between a retaining position in which the lock members inhibit rotation of the drum and/or movement of the belt, and a release position in which the lock members permit rotation of the drum and/or movement of the belt, the first elastic members being configured to wind the belt around the drum when the lock members are in the release position;

first actuator members, operable on the lock members to switch the lock members to the release position; and second actuator members, operable on the first actuator members and/or on the lock members to switch the lock members to the retaining position.

2. The booster seat as claimed in claim 1, wherein the lock members operate on the belt and comprise a slider configured to move between the retaining position, in which the lock members mechanically interfere with the belt to inhibit movement thereof, and the release position, in which the lock members do not interfere with the belt; the lock members further comprising a carriage which contacts the slider; the first and second actuator members operating on the carriage.

3. The booster seat as claimed in claim 1, wherein the first actuator members comprise a user-operable pushbutton.

4. The booster seat as claimed in claim 3, wherein the pushbutton is placed on a bottom surface of the seat.

5. The booster seat as claimed in claim 1, wherein the second actuator members comprise a pushbutton projecting out of a front surface of the seat and configured to be actuated by a user.

6. The booster seat as claimed in claim 2, comprising second elastic members, operating on the carriage and/or the slider, and configured to counteract the movement of the slider from the retaining position to the release position.

7. The booster seat as claimed in claim 1, wherein the first actuator members are configured to be stably switched to a stable unlocked position, in which the lock members are in the release position, and to an inactive position, in which the first actuator members do not interact with the lock members.

8. The booster seat as claimed in claim 2, wherein the first actuator members are configured to be stably switched to a stable unlocked position, in which the lock members are in the release position, and to an inactive position, in which the first actuator members do not interact with the lock members, and wherein the first actuator members, in the stable unlocked position, counteract the second elastic members and push the carriage against the slider, thereby stably switching the slider to the release position.

9. The booster seat as claimed in claim 8, wherein the first actuator members, in the stable unlocked position, are in counteracting relationship to third elastic members.

10. The booster seat as claimed in claim 9, wherein the second actuator members are configured to move between an active position, in which the second actuator members break the stability of the stable unlocked position of the first actuator members, thereby allowing the third elastic members to switch the first actuator members to the inactive position, and an inactive position.

11. The booster seat as claimed in claim 10, wherein the second actuator members, in the active position, allow the second elastic members to switch the slider to the retaining position.

12. A booster seat for children, comprising:

a seat having an inner cavity;

at least one winding drum, in the inner cavity, configured to rotate in a first direction in which a belt is unwound from the at least one winding drum and to rotate in a second direction in which the belt is wound up on the at least one winding drum;

first elastic members, configured to operate on the at least one winding drum to counteract rotation of the at least one winding drum in the first direction;

lock members, configured to operate on the at least one winding drum, and configured to switch between a retaining position, in which the lock members inhibit rotation of the at least one winding drum, and a release position, in which the lock members permit rotation of the at least one winding drum, the first elastic members configured to wind the belt around the at least one winding drum when the lock members are in the release position;

first actuator members, configured to operate on the lock members to switch the lock members to the release position; and second actuator members, configured to operate on the first actuator members and/or on the lock members to switch the lock members to the retaining position.

13. The booster seat of claim 12, wherein the first actuator members comprise a user-operable pushbutton.

14. The booster seat of claim 13, wherein the user-operable pushbutton is on a bottom surface of the seat.

15. The booster seat of claim 12, wherein the second actuator members comprise a pushbutton projecting out of a front surface of the seat, and wherein the pushbutton is configured to be actuated by a user.

16. A booster seat for children, comprising:

a seat having an inner cavity;

at least one winding drum, in the inner cavity, configured to rotate in a first direction in which a belt is unwound from the at least one winding drum and to rotate in a second direction in which the belt is wound up on the at least one winding drum;

first elastic members, configured to operate on the at least one winding drum to counteract rotation of the at least one winding drum in the first direction;

lock members, configured to operate on the belt, and configured to switch between a retaining position, in which the lock members inhibit movement of the belt, and a release position, in which the lock members permit movement of the belt, the first elastic members configured to wind the belt around the at least one winding drum when the lock members are in the release position;

first actuator members, configured to operate on the lock members to switch the lock members to the release position; and second actuator members, configured to operate on the first actuator members and/or on the lock members to switch the lock members to the retaining position.

17. The booster seat of claim 16, wherein the lock members comprise a slider configured to move between the retaining position, in which the lock members mechanically interfere with the belt to inhibit the movement of the belt, and the release position, in which the lock members do not interfere with the belt.

18. The booster seat of claim 17, wherein the lock members further comprise a carriage which contacts the slider, and wherein the first and second actuator members are configured to operate on the carriage.

19. The booster seat of claim 16, wherein the first actuator members comprise a user-operable pushbutton.

20. The booster seat of claim 19, wherein the user-operable pushbutton is on a bottom surface of the booster seat.

* * * * *